United States Patent [19]

Suzuki et al.

[11] Patent Number: 5,040,998

[45] Date of Patent: Aug. 20, 1991

[54] PLUG CONNECTOR FOR MICROSTRIP LINE

[75] Inventors: Takao Suzuki; Yoshiharu Tamura; Naoki Hirasawa, all of Tokyo, Japan

[73] Assignees: Japan Aviation Electronics Industry Limited; NEC Corporation, both of Tokyo, Japan

[21] Appl. No.: 668,314

[22] Filed: Mar. 11, 1991

Related U.S. Application Data

[63] Continuation of Ser. No. 510,833, Apr. 18, 1990, abandoned.

[30] Foreign Application Priority Data

| | | | |
|---|---|---|---|
| Apr. 20, 1989 | [JP] | Japan | 1-47071[U] |
| Apr. 20, 1989 | [JP] | Japan | 1-47072[U] |
| Apr. 20, 1989 | [JP] | Japan | 1-47073[U] |
| Apr. 20, 1989 | [JP] | Japan | 1-47074[U] |

[51] Int. Cl.[5] ..... H01P 3/08

[52] U.S. Cl. ..... 439/79; 439/108; 333/246; 333/260

[58] Field of Search ..... 333/246, 260; 439/79, 439/101, 108

[56] References Cited

U.S. PATENT DOCUMENTS

| | | | |
|---|---|---|---|
| 2,825,883 | 3/1958 | Batcheller | 439/849 |
| 3,643,201 | 2/1972 | Harwood | 333/246 |
| 4,418,972 | 12/1983 | Benasutti | 439/79 |
| 4,659,155 | 4/1987 | Walkup et al. | 439/79 |
| 4,710,133 | 12/1987 | Lindeman | 439/101 |
| 4,887,353 | 12/1989 | Preputnick | 439/79 |

OTHER PUBLICATIONS

IBM Technical Disclosure Bulletin, "Plug . . . Cable to Card Connector", vol. 5, No. 4, Sep. 1962, p. 28.

*Primary Examiner*—Gary F. Paumen

*Attorney, Agent, or Firm*—Pollock, VandeSande and Priddy

[57] ABSTRACT

A plug connector used to connect a microstrip line and another microstrip line. The body of the plug connector, which is made of an insulating material of an oblong shape, has a signal contact housing hole and a ground contact housing hole. These holes are in parallel and opposed to each other. A signal female contact made of a metal plate is housed in the signal contact hole and a ground female contact made of a metal plate is contained in the ground contact housing hole. The ground female contact has a ground plate of a width wider than the width of the signal female contact. The ground female contact and the signal female contact constitute substantially a microstrip line.

8 Claims, 6 Drawing Sheets

PLUG CONNECTOR FOR MICROSTRIP LINE

This application is a continuation of U.S. Ser. No. 07/570,833, filed on Apr. 18, 1990, now abandoned.

BACKGROUND OF THE INVENTION

The present invention relates to a connector for connecting a microstrip line and another microstrip line, in particular, to a plug connector for joining them.

Nowadays, in order to connect a microstrip line formed on a print substrate and another microstrip line formed on another print substrate, both microstrip lines have been converted to coaxial lines by a coaxial connector and then connected by means of a coaxial connector.

It is difficult to adjust both a strip line and a coaxial line at the connection portion of these lines because the shapes of these lines are different from each other even though the transmission mode of the strip line and the transmission mode of the coaxial line are of the same TEM wave mode. Though the strip lines are obtained at a low cost, the coaxial connectors are relatively expensive.

On the other hand, because strip lines are essentially of non-balanced mode, it is difficult to obtain matched connections even if an ordinary connector equivalent to two balanced lines having a balanced mode is used for the strip line.

In consequence, it is a purpose of the present invention to provide a plug connector for microstrip lines which can connect the microstrip lines with good impedance matching without converting them to coaxial lines, and which can be manufactured at a low cost.

It is another purpose of the present invention to provide a plug connector of a multicore connection system which allows a multicore connection with good matching without converting them to coaxial lines, and which can be manufactured at a low cost.

It is still another purpose of the present invention to provide a plug connector for microstrip lines, which has less crosstalk.

SUMMARY OF THE INVENTION

According to the present invention, the body of a plug connector made of an insulating material has a pair of holes, i.e. a signal contact housing hole, and a ground contact housing hole formed in the body so as to be in a parallel and confronting relation to each other. A signal female contact is housed in the signal contact housing hole and a ground female contact is contained in the ground contact housing hole. The ground female contact has a ground plate that is at least twice as wide as the width of the signal female contact. The signal female contact and the ground female contact construct the strip line.

A terminal integral with the signal female contact extends from the rear face of the body so as to be connected to a signal line of the strip line. A ground plate projects from the rear face of the body so as to be connected with the ground line of the strip line.

The signal female contact consists of a plate portion having a constant width and extending along the front and rear direction, and a contact piece which resiliently contacts the plate portion and is formed integrally with the plate portion. Between the plate portion and the contact piece, a signal male contact of a socket connector is adapted to be pressed into and contact them. The ground female contact, the contact piece, the ground plate or the plate portion resiliently hold the ground male contact of the socket connector in order to make contact with the ground male contact.

The body can be provided with a vacant hole at a place between the signal female contact and the ground female contact in order to raise the characteristic impendance of a line consisting of the signal female contact and the ground female contact and to improve the matching between the line and the strip line.

The two side edges of the ground plate can be integrally bent toward the signal female contact side and extended to form a U-shaped ground plate which encloses the signal female contact.

A plurality of pairs of the signal contact housing hole and the ground contact housing hole can be arranged and formed in the body. Each signal female contact is housed in a respective signal contact housing hole and the contact contacting portions of respective ground female contacts are contained in the ground contact housing holes. A slit-like ground plate hole communicating with a side of each ground contact housing hole is formed in the body and a ground plate common to respective contact contacting portions is housed in the ground plate hole. In consequence, respective ground female contacts are constructed.

DESCRIPTION OF THE PREFERRED EMBODIMENT

Figure 1:
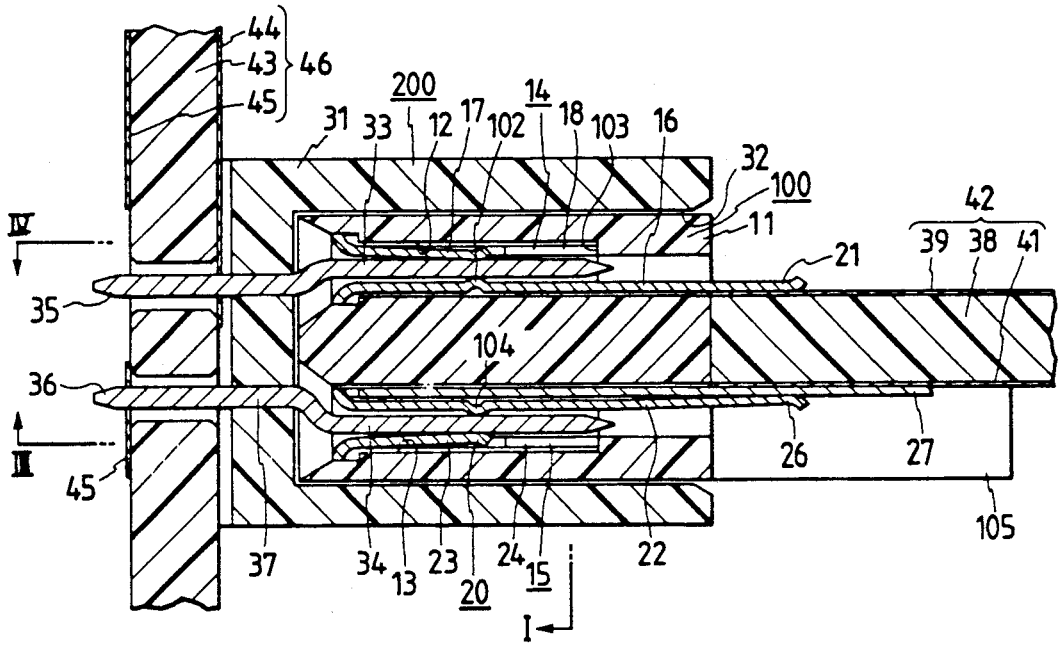
FIG. 1 shows a section of the plug connector of the preferred embodiment according to the present invention and a socket connector assembled to the plug connector.

FIGS. 1–4, respectively show the first preferred embodiment of the plug connector of the present invention. In this first embodiment, a microstrip line 42 and another microstrip line 46 are connected by the plug connector 100. The microstrip line 42 has a horizontal insulating base plate 38 seen on the right portion of FIG. 1, a signal line 39 and a ground line 41, formed on the respective sides of the base plate 38. The microstrip line 46 seen on the left has a signal line 44 and a ground line 41 formed and arranged on the respective sides of a vertical insulating base plate 43. In order to connect these microstrip lines 42 and 46, the plug connector 100 is applied to an end of the strip line 42, a socket connector 200 for microstrip lines is applied and secured to an end face of the microstrip line 46. Then, the plug connector 100 is inserted as shown into the socket connector 200 in order to connect the microstrip line 42 to the microstrip line 46 as shown in FIG. 1.

Figure 2:
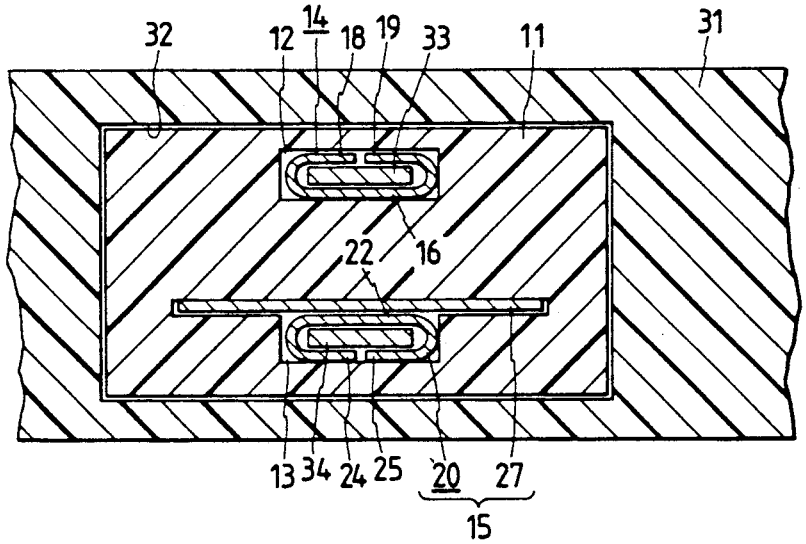
FIG. 2 is a section taken along the line II in FIG. 1.

As shown in FIGS. 1 and 2, the plug connector 100 of the present invention has a square-shaped body 11 manufactured by a molding process of synthetic resin. A signal contact housing hole 12 and a ground contact housing hole 13 are formed to extend rearward from the front face of the body 11 in a parallel and confronting relation to each other. The section of these housing holes 12 and 13 is substantially oblong, and the long sides of the holes face each other. A signal female contact 14 is housed in the signal contact housing hole 12 and a ground female contact 15 is housed in the ground contact housing hole 13.

Figure 6:
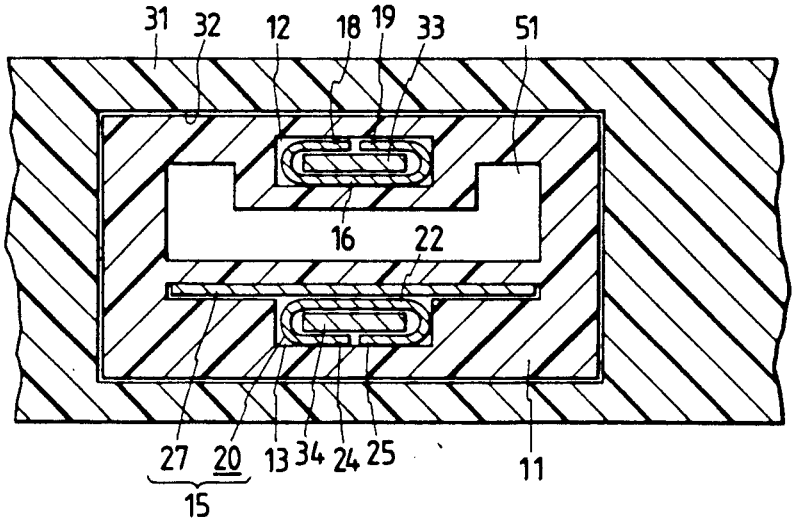
FIG. 6 is a section taken along the line VI of FIG. 5.

The signal female contact 14 has a plate portion 16 contacting an inner face of the signal contact housing hole 12 at the side of the housing hole 13. Both side edges of the plate portion 16 respectively are turned back. As shown in FIGS. 1, 2 and 6, the plate portion 16 has a front contact piece 17 and a pair of holding portions 18 and 19, respectively formed integral with the plate portion 16. The front contact piece 17 has a groove 101 formed from its rear end and connected to the plate portion 16 through its front portion, forming a rearward extending tongue portion. The rear portion of the contact piece 17 is bent so as to be adjacent to the plate portion 16. As shown clearly in FIG. 1. the plate portion 16 has a projection 102 projected toward the contact piece 17. The plate portion 16 has a terminal 21 extending from the rear end of the plate portion 16 and the terminal 21 extends from the rear face of the body 11. The width of the plate portion 16 is substantially the same as that of the signal line 39 of the microstrip line 42 to be connected to the other microstrip line 46.

Figure 4:
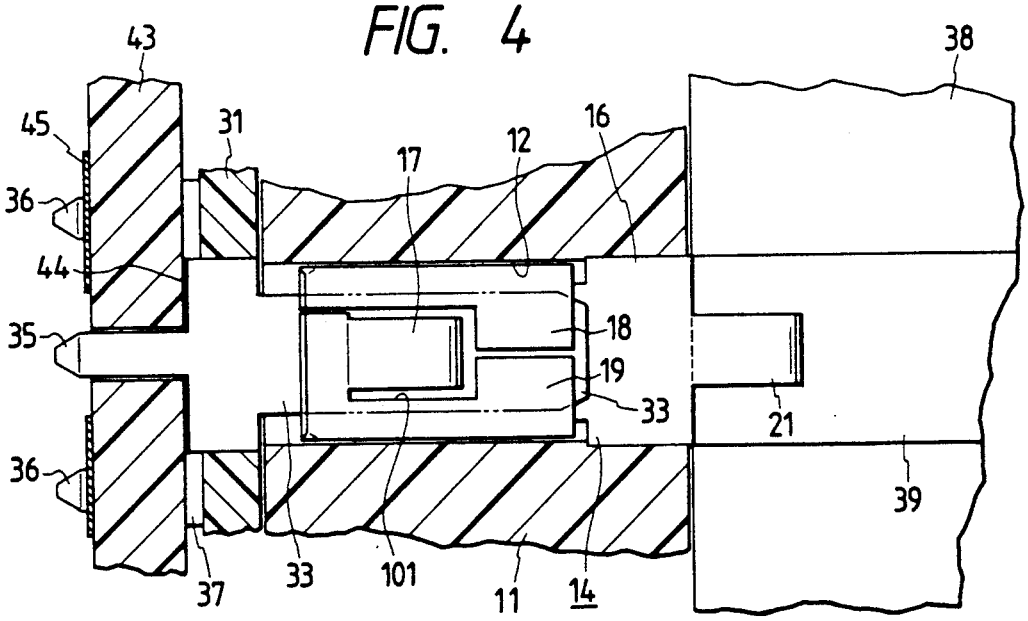
FIG. 4 is a section taken along the line IV in FIG. 1.

As shown in FIG. 1, the rear portion of the contact housing hole 12 is made narrow to form a stepped portion 103. When the signal female contact 14 is inserted into the contact housing hole 12 through the front opening, the rear end of the portions 18 and 19 engage with the stepped portion 103 determining the inserting position. As shown in FIG. 4, the rear end portion of the plate portion 16 is restricted in its width so as to make the rear end portion of the plate portion 16 pressed and held in the contact housing hole 12.

The ground female contact 15 consists of a contact portion 20 and a ground plate 27, and the contact portion 20 has a shape substantially similar to that of the signal female contact 14 and a plate portion 22. Both side edges of the plate portion 22, respectively are folded toward each other. The ground female contact 15 has a front contacting piece 23 and a pair of rear holding portions 24, 25. The rear end portion of the contacting piece 23 is adjacent to the plate portion 22 and the projection 104 projected from the plate portion 22 is confronted to the contacting piece 23. The plate portion 22 has a terminal 26 integrally formed on the rear end of the plate portion so as to project from the rear face of the body 11. A ground plate 27 is provided so as to be adjacent to the plate portion 22. The width of the ground plate 27 is wider than that of the signal female contact 14 by about three times. According to the first preferred embodiment of the present invention, it is almost the same as the width of the ground line 41 of the microstrip line 42 to be connected, and the ground plate 27 is adapted to project from the rear face of the body 11. In detail, the ground plate 27 projects from both the sides of the contact portion 20 in almost the same length and the portion of the contact housing hole 13 at the side of the contact housing hole 12 is enlarged as shown in FIG. 2 corresponding to the length of the ground plate 27.

Figure 3:
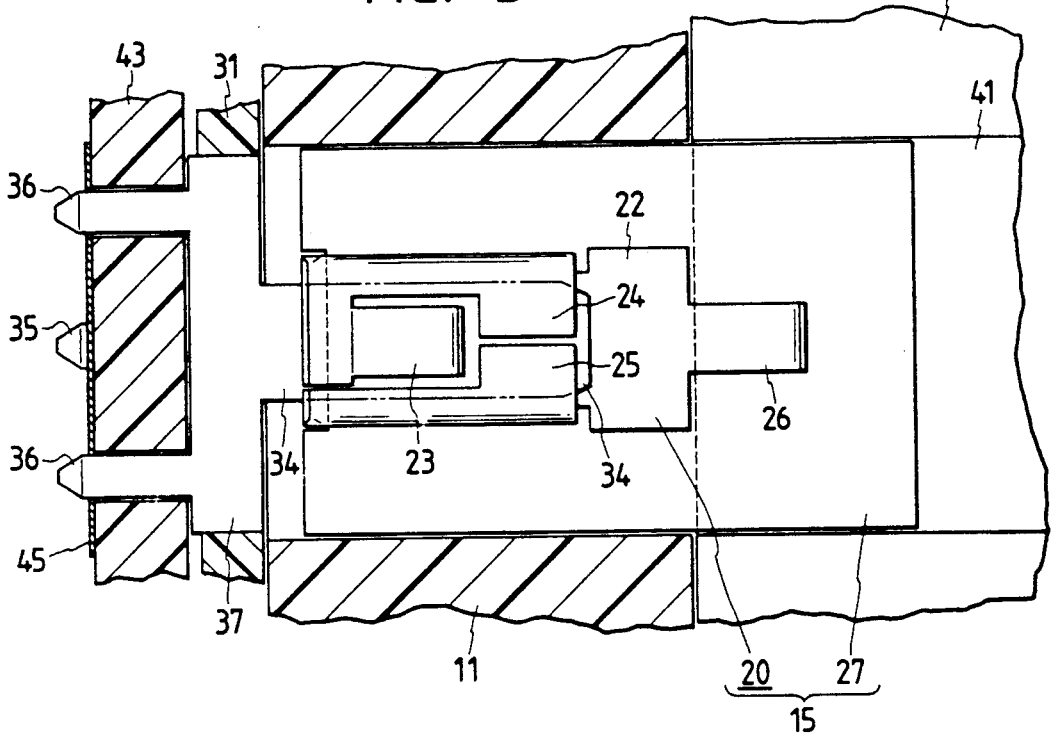
FIG. 3 is a section taken along the line III in FIG. 1.

The socket connector 200 to be connected to the plug connector 100 according to the present invention has an insulating material body 31. The body 31 has a square opening 32 formed in the front face of the body 31. The body 11 of the plug connector 100 is inserted into the square opening 32. On the bottom face of the opening 32, a plate-like signal male contact 33 and a plate-like ground male contact 34 are opposedly planted. A terminal 35 of the signal male contact 33 and another terminal 36 of the ground male contact 34 respectively project from the rear face of the body 31. As shown in FIG. 3, the width of the base portion 37 of the ground male contact 34 buried in the body 31 is made identical with that of the ground line of the microstrip line to be joined. The distance between the signal male contact 33 and the ground male contact 34 is made substantially identical with the center distance between the signal female contact 14 and the ground female contact 15. The end face of the microstrip line 42 confronts the rear face of the body 11 of the plug connector 100, the terminal 21 is soldered to the signal line 39, the ground plate 27 is soldered to the ground line 41, and the terminal 26 of the plate portion 22 is soldered to the ground plate 27. The distance between the plate portion 16 of the signal female contact 14 and the ground plate 27 is almost the same as the distance, between the signal line 39 and the ground line 41. An attachment member 105 that projects rearwardly and integrally from the rear face of the body 11 confronts with the ground line 41, and the attachment member 105 is fixed to the insulating base plate 38 by means of a screw (not shown). The microstrip line 46 has a plurality of holes formed therein through which the terminals 35 and 36 are inserted, respectively. The terminal 35 is connected to the signal line 44 by soldering and the terminal 36 is similarly connected to the ground line 45. When the body 11 of the plug connector 100 of the present invention is inserted into the body 31 of the socket connector 200, the signal male contact 33 is pressed into and between the contact piece 17 and the plate portion 16 of the signal female contact 14, and the ground male contact 34 is pressed into and between the plate portion 22 and the contact piece 23 of the ground female contact 15 so as to connect electrically and effectively the microstrip line 42 to the microstrip line 46.

According to the first preferred embodiment of the present invention, though the ground female contact 15 is manufactured in two parts, i.e. the plate portion 22 and the ground plate 27, these parts may be integrally formed by uniting them using soldering or welding. Alternately, it is also possible to manufacture the plate portion 22 and the ground plate 27 by using a single metal plate, or the contact piece 23, the holding portions 24, 25 are made integrally by bending them. The holding portions 18, 19 and 24, 25 are adapted to prevent abnormal force from being applied to the contact piece 17 even though the signal male contact 33 is slanted.

Figure 5:
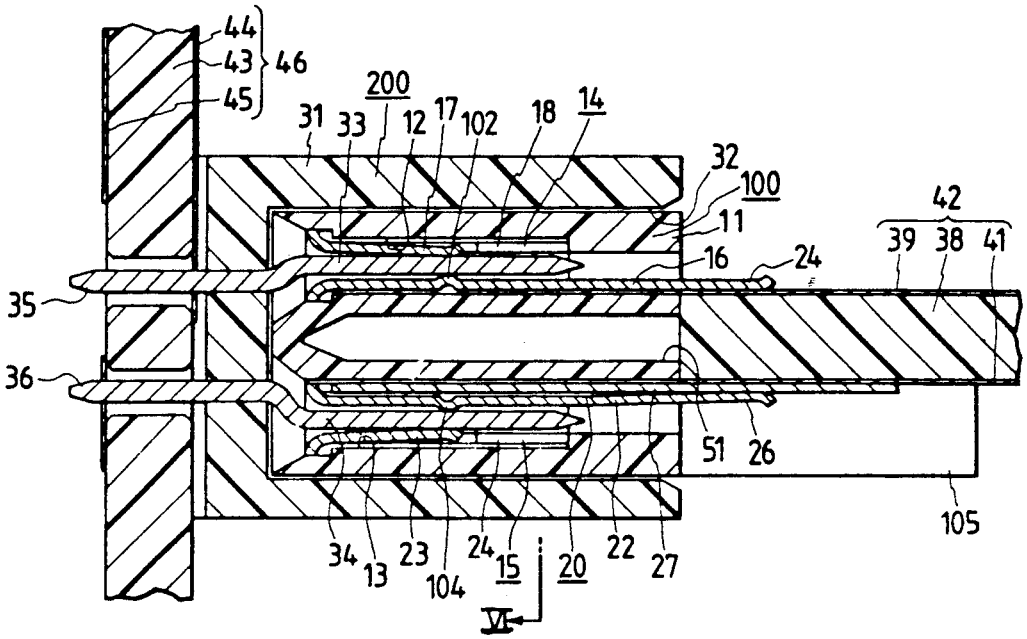
FIG. 5 is a section similar to FIG. 1 and shows the plug connector of another preferred embodiment and the socket connector connected to the plug connector.

FIGS. 5 and 6 depict the second embodiment of the plug connector according to the present invention. It is noted that the second embodiment has a construction substantially identical to that of the first embodiment shown in FIGS. 1-4, so the corresponding parts or members in the first and second embodiments have the identical reference numerals or symbols. According to the second embodiment of the plug connector, a vacant hole 51 is formed between the signal female contact 14 and the ground female contact 15 of the plug connector 100 so as to extend from the rear face of the body 11 to near its front face. The width of the vacant hole 51 is made substantially identical with the width of the ground plate 27 and both sides of the vacant hole 51 bend toward the signal female contact 14 and extend by short distances.

Because a relative dielectric constant of this part of the body 11 is small due to the existence of the vacant hole 51 in the part, the characteristic impedance of a line of the signal female contact 14 and the ground female contact 15 rises, so that the relative dielectric constant of the body 11 itself is raised. However, it is possible to match the line of the signal female contact 14 and the ground female contact 15 with the microstrip line 42 in impedance by suitably selecting the size of the vacant hole 51, even though the body 11 is made of a mechanically strong material.

Figure 7:
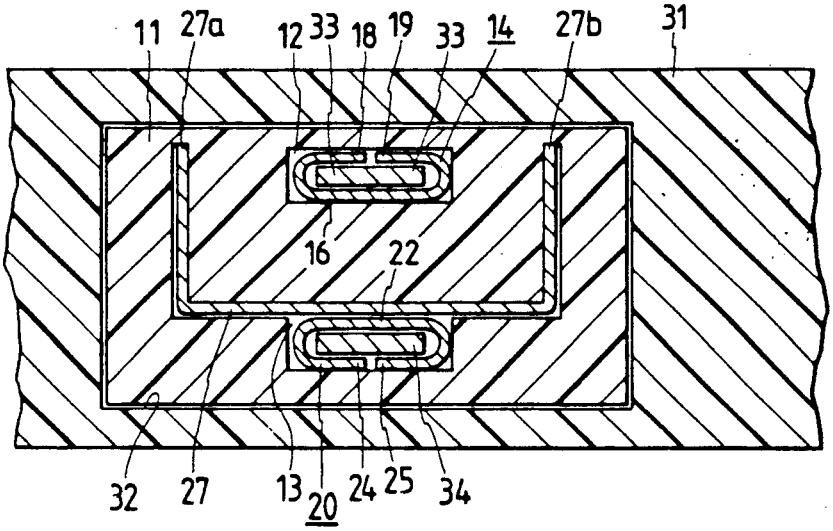
FIG. 7 is similar to FIG. 2 and depicts still another preferred embodiment of the present invention.
Figure 8:
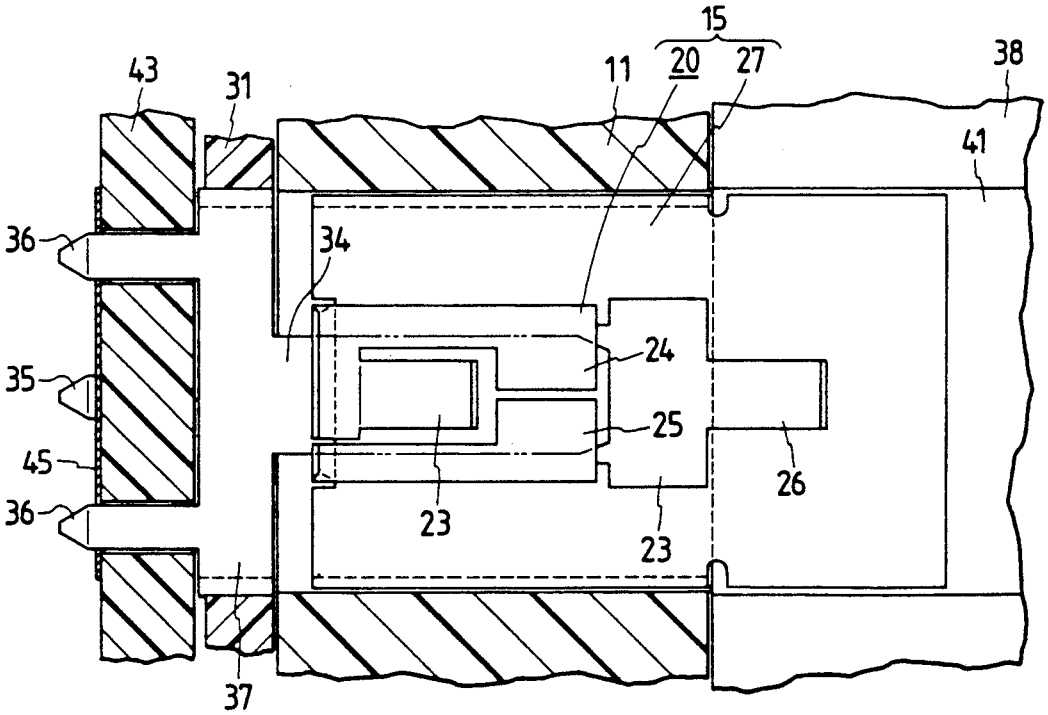
FIG. 8 is a section similar to FIG. 3 and showing the embodiment of FIG. 7.
Figure 9:
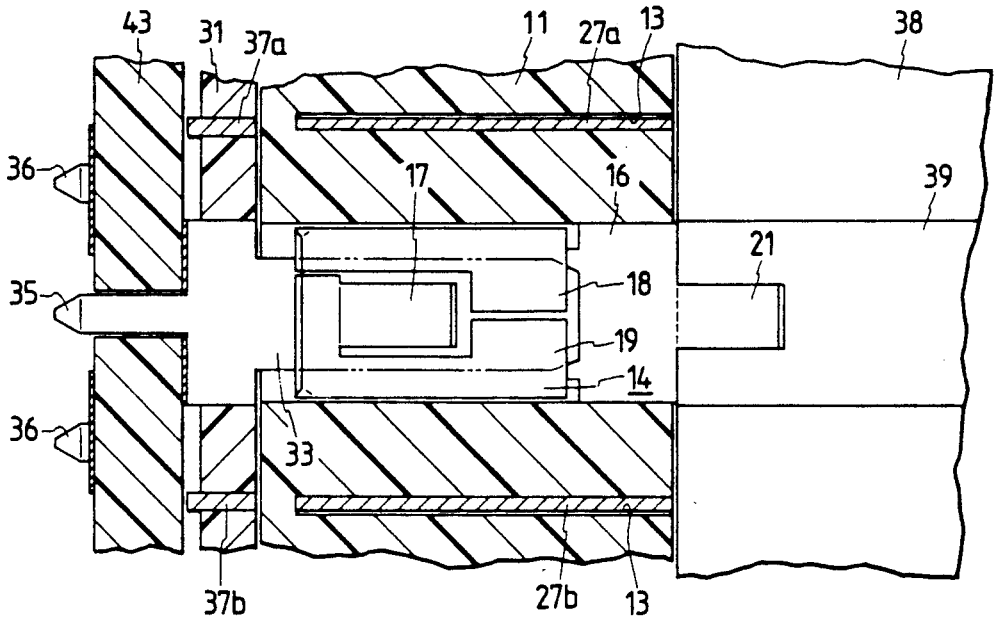
FIG. 9 is a section corresponding to FIG. 4 and showing the embodiment of FIG. 7.

FIGS. 7–9 depict the third preferred embodiment of the present invention and these figures correspond to FIGS. 2–4. The section shown in FIG. 1 can be used in the following explanation of the third embodiment. In the third embodiment, the ground plate 27 has both sides respectively bent at a right angle to form extensions 27*a* and 27*b*, between which the signal female contact 14 is situated as seen in FIG. 7. Thus, the ground plate 27 has a substantially U-shaped cross-section and the contact housing hole 13 has a shape enabling it to house the ground plate 27. The portion of the ground plate 27 extending from the body 11 is made flat without forming of the extensions 27*a*, 27*b*. Corresponding to the shape of the ground plate 27 provided with the extensions 27*a*, 27*b*, the base portion 37 of the ground male contact 34 of the socket connector 200 has both side portions bent at a right angle as shown in FIGS. 8 and 9 and extending to form extensions *37a*, 37*b*.

According to the above explained construction, in the case of a multi-core connector, adjacent signals are separated by the ground plate 7 lessening crosstalk. In addition, in microstrip lines, arrangement of a ground line between parallel signal lines easily decreases a level of crosstalk.

Figure 10:
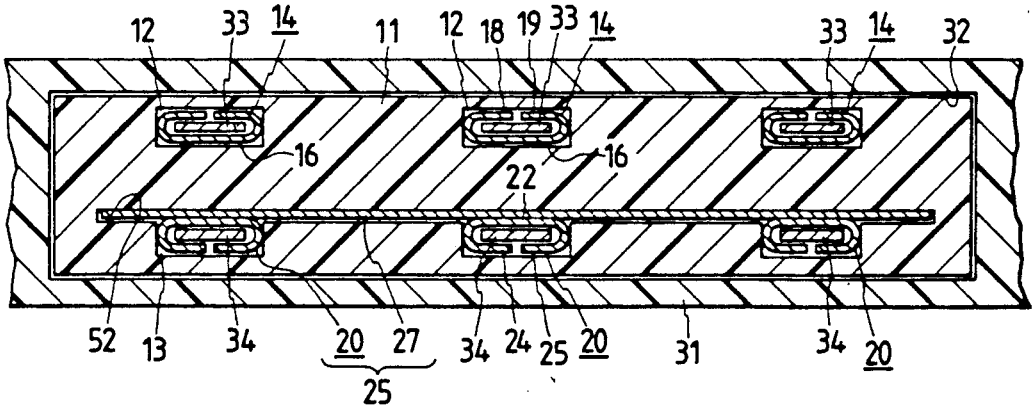
FIG. 10 is a section corresponding to FIG. 2, showing the preferred embodiment in which the plug connector of the present invention is applied to the multicore connector.
Figure 11:
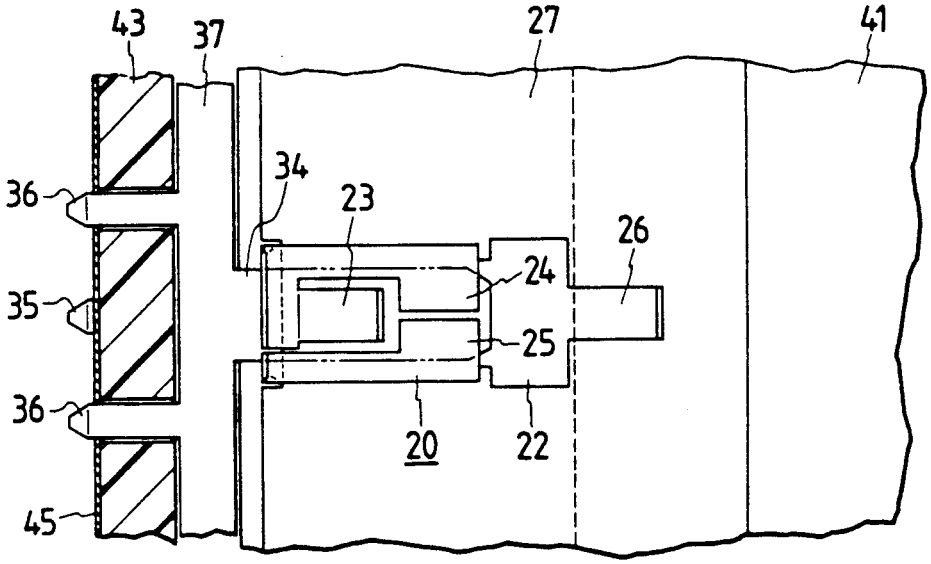
FIG. 11 is a section corresponding to FIG. 3 and depicting the embodiment of FIG. 10.

FIGS. 10 and 11 shows the case in which the preferred embodiment of the plug connector of the present invention shown in FIGS. 1–4 is app'ied to a multicore plug connector. It is apparent that respective sections shown in FIGS. 1–4 are used in the following of the case. As shown in FIG. 10, the body 11 has an oblong shape and a plurality of pairs of the signal contact housing hole 12 and the ground contact housing hole 13 are arranged transversely in the body 11. Signal female contacts 14 are contained in these signal contact housing holes 12 and respective contact contacting portions 20 are inserted into respective ground contact housing holes 13.

A slit-like ground plate housing hole 52 communicated with the ground contact housing holes 13 is formed in the body 11 so as to communicate the holes 13 to one another through the side of each ground contact housing hole 13 which faces the signal contact housing hole 12. The ground plate 27 is housed in the ground plate housing hole 52 in order to contact with and connect to respective contact portions 20. Corresponding to the construction above, as shown in FIG. 11, the bases 37 of the plurality of the ground male contacts 34 of the socket connector are connected to one another in the body 31. The distance of pitch between the signal female contacts 14 is identical with the distance between signal lines of the microstrip line to be connected.

In the multicore plug connector of the present invention, it is possible to form the vacant hole 51 shown in FIG. 5 in the construction of the plug connector. It is also possible to provide an extension, 27*a* or 27*b* as shown in FIG. 7 on the ground plate 27 erected thereon at a right angle in order to isolate respective signal female contacts 14 from each other.

As described above, according to the present invention, because the signal female contact 14 and the ground female contact 15 constructs the microstrip line, it is possible to make a connection with the microstrip line matched effectively in impedance. It is possible to make the signal female contact 14 and the ground female contact 15 by a bending process of metal plate and the body 11 by a molding process of synthetic resin, so that it is very easy and economical to manufacture the plug connector of the present invention.

What is claimed is:

1. A plug connector for a microstrip line composed of a signal line and a ground line formed in opposing relation to each other on opposite surfaces of a base plate, comprising:

an oblong-shaped body made of an insulating material and provided with a signal contact housing hole and a ground contact housing hole, said holes being formed to extend rearward from a front face of the body in parallel to each other;

a signal female contact housed in said signal contact housing hole, said signal female contact having a folded portion formed by folding a metal sheet to form a flat insertion slot whose width is approximately equal to that of the signal line of said microstrip line for receiving therein an elongated plate-like signal male contact of a mating socket, said signal female contact having a plate portion whose width is substantially the same as the width of the signal line, said plate portion extending rearward from said folded portion to at least a rear end of said body to reach said signal line of the microstrip line in alignment therewith, sand said plate portion having a projecting portion that projects out of a rear end of said signal contact housing hole to form a signal terminal extending on and connected to said signal line of the microstrip line; and a ground female contact housed in said ground contact housing hole, said ground female contact having a ground plate whose width is at least twice the width of said signal female contact and substantially equal to the width of the ground line of said microstrip line, said ground plate extending rearward from near the front end of said ground housing hole to form a projecting rearward out of said ground housing hole to form a ground terminal extending on and connected to said ground line of the microstrip line, said ground female contact being spaced from said signal female contact by a distance that is substantially equal to a thickness of said base plate.

2. The plug connector for microstrip lines according to claim 1, wherein said body has a vacant hole formed between said signal female contact and said ground female contact.

3. The plug connector for microstrip lines according to claim 1, wherein marginal sides of said ground plate are bent substantially at a right angle to form extensions so that said signal female contact is located between the extensions of the ground plate.

4. The plug connector for microstrip lines according to claim 1, wherein said body is provided with plural pairs of said signal contact housing hole and said ground contact housing hole formed in the body and arranged in a straight line, a plurality of said signal female contacts being housed respectively in said signal contact housing holes, a plurality of said ground female contacts being housed respectively in said ground contact housing holes, and said ground plate of the ground female contacts being a single member that communicates with each of said ground contact housing holes.

5. The plug connector for microstrip lines according to any one of claims 1 or 2 to 4, wherein said signal female contact has a contact piece which is formed by bending a part of a marginal side of the plate portion into an opposing relation to the plate portion.

6. The plug connector for microstrip lines according to claim 5, wherein said signal female contact has a pair of holding portions formed by folding parts of both marginal sides of the plate portion at the rear of the contact piece into opposing relation to the plate portion.

7. The plug connector for microstrip lines according to any one of claims 1 or 2 to 4, wherein said ground female contact has an integral plate portion extending rearwardly along said ground plate in contact therewith and a contact piece formed by bending a part of a marginal side of said integral plate portion in opposing relation thereto.

8. The plug connector for microstrip lines according to claim 7, wherein parts of both marginal sides of the plate portion, at the rear of the contact piece, are folded in order to form a pair of holding portions in opposing relation to the plate portion.

* * * * *